US005289801A

United States Patent [19]

Burks

[11] Patent Number: 5,289,801

[45] Date of Patent: Mar. 1, 1994

[54] CALF CARRIER

[76] Inventor: Geoffrey R. Burks, P.O. Box 215, Stratton, Nebr. 69043-0215

[21] Appl. No.: 88,923

[22] Filed: Jul. 6, 1993

[51] Int. Cl.[5] ..... A61D 3/00

[52] U.S. Cl. ..... 119/728

[58] Field of Search ..... 119/102, 96, 100, 101, 119/98

*Primary Examiner*—Gene Mancene
*Assistant Examiner*—Thomas Price
*Attorney, Agent, or Firm*—Richard W. Hanes

[57] ABSTRACT

A small animal carrier and support device comprising a cantilevered beam having inner and outer ends, a pair of spaced apart generally "U" shaped body cradle members rigidly attached to the said beam, a mounting post angularly attached to the inner end of the beam and wherein said mounting post comprises a hollow tubular member having an aperture in a side wall thereof, and a locking plier having a shortened upper jaw and a lower jaw wherein the shortened upper jaw is attached to the side wall of the tubular member adjacent to and above the side wall aperture and the lower jaw thereof is disposed within the aperture so that the lower jaw may be closed against the lower surface of a trailer type hitching ball which is positioned inside the lower end of the tubular member for attachment of the carrier to a supporting structure or transporting vehicle.

6 Claims, 2 Drawing Sheets

CALF CARRIER

BACKGROUND OF THE INVENTION

In the raising of small animals such as calves, it is often necessary to move the cow-calf pair from one location to another. Driving the pair can be time consuming and frustrating for one individual. If the calf were to be carried, however, the mother cow would follow and the moving task would be greatly simplified.

Accordingly, it is the primary object of the present invention to provide an easily loaded carrier for a young calf that can be easily and quickly attached to the ball trailer hitch of a vehicle.

A second object of the invention is to provide a universal hitch for the carrying cradle which will attach to either a 1⅞ inch or a 2 inch diameter ball.

Another object of the invention to provide a humane and safe carrying apparatus for a calf which will fully support the calf and provide a means for transporting the calf in full view of the mother cow so as to induce the cow to follow the calf.

The hitch of the carrying apparatus lends itself to attachment to a headgate or post, thus permitting the calf carrier to be mounted in a position where a very young calf can be supported while nursing its mother, if the calf is ill or its legs are not yet strong enough to support its weight.

Therefore, a still further object of the invention is to provide a nursing support for very young animals.

Other and still further objects, features and advantages of the present invention will become apparent upon a reading of the following detailed description of a preferred form of the present invention.

SUMMARY OF THE INVENTION

The calf carrier and support includes a cantilevered beam which carries two spaced apart "U" shaped cradle members for cradling the animal's body between the hind legs and forelegs. The beam is attached at one of its ends to a perpendicular tube with an open bottom end fitted over the ball of a standard trailer hitch attached to a vehicle or to a stationary support. An opening in the side wall of the tube permits the entry of the lower jaw of a locking plier type of tool, the upper jaw of which is welded or otherwise fixedly attached to the outside of the tubular wall just above the aperture, providing a locking means for firmly attaching the carrier to the ball hitch without concern for the size of the ball.

DETAILED DESCRIPTION OF THE INVENTION

Figure 1:
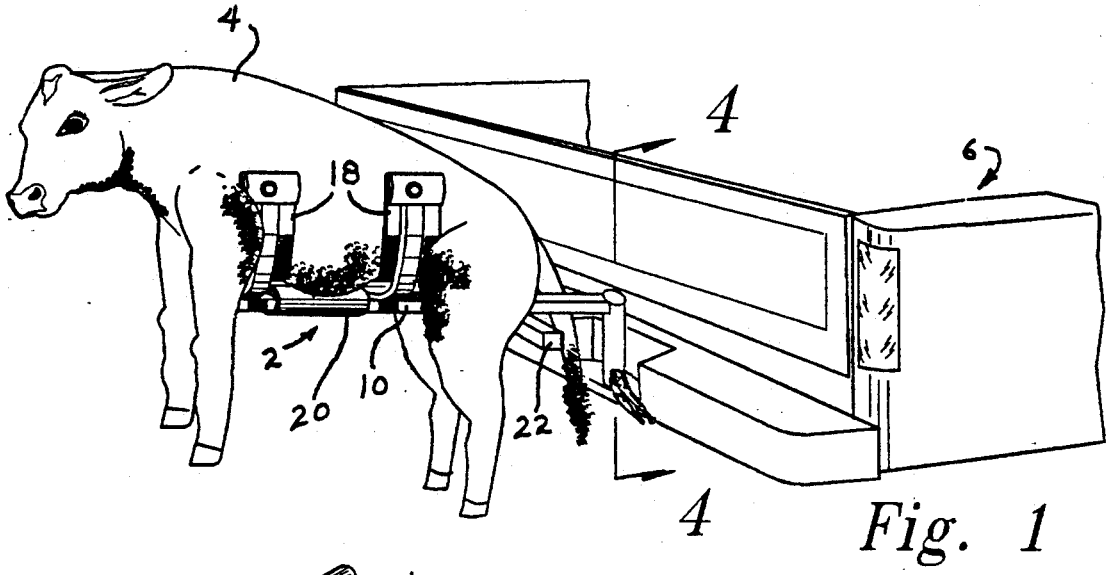
FIG. 1 is a perspective view of the animal carrier of the present invention with a calf loaded therein as it would appear attached to the ball hitch of a typical pickup truck, which is only fragmentarily shown.
Figure 2:
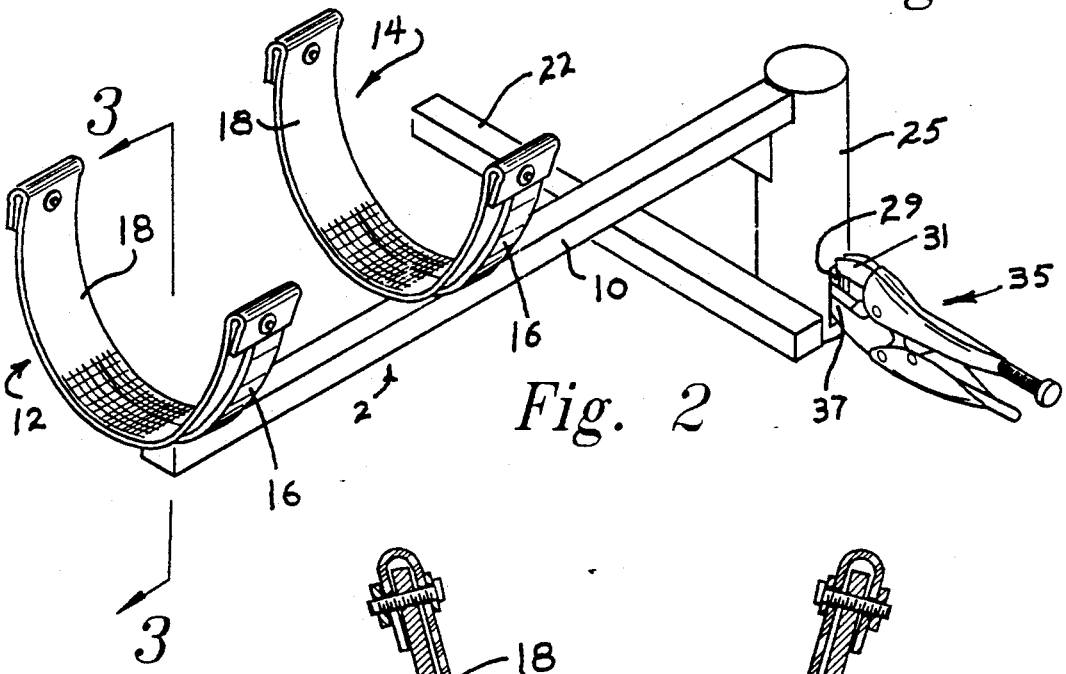
FIG. 2 is an enlarged perspective view of the animal carrier.

Referring to FIGS. 1 and 2, a preferred form of the animal carrier of the present invention is indicated generally by reference numeral 2. In FIG. 1, a calf 4 is shown as being supported in a position that will induce the mother cow to follow the calf as the pickup truck 6 is slowly driven from one spot to another where it is desired to locate the cow-calf pair.

Figure 3:
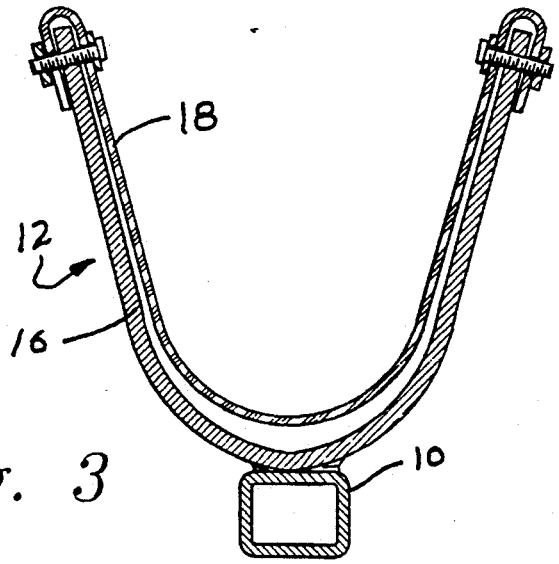
FIG. 3 is a cross sectional view of the carrier taken along lines 3—3 of FIG. 2.

The carrier 2 includes a cantilevered main beam 10 which carries two spaced apart and similarly constructed "U" shaped support cradles 12 and 14. Each of the cradles comprise a "U" shaped steel strap 16 having an expanded open end, which strap is welded at the mid point of its closed end base portion to the main beam 10, as seen best in FIG. 3. Bolted to the upper ends of each stem or side of the expanded "U" shaped strap 16 are the ends of an elastic strap 18, such as rubber, which contacts and cradles the body of the animal, as shown in FIG. 1. A cylindrical length of plastic or rubber hose 20 may be loosely fitted over the mid portion of the main beam 10 between the cradle members 12 and 14 to protect the belly of the animal from abrasive contact with the beam 10. The belly protection is optional since the short duration of the animal's contact will ordinarily not be a problem. A cross bar 22 positioned rearwardly of the aft body supporting cradle 14 is attached perpendicularly to the main beam 10 to provide support to the hind legs of the animal, taking a small amount of the animal's weight off the rearward support cradle 14.

Figure 4:
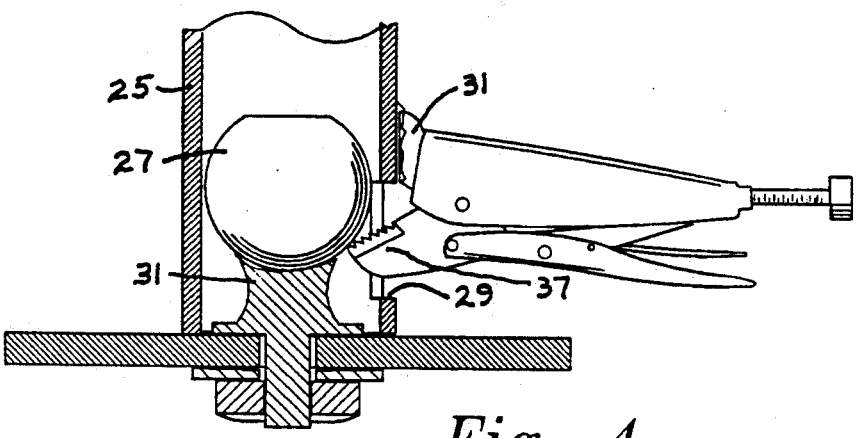
FIG. 4 is a cross sectional view of the carrier hitch taken along lines 4—4 of FIG. 1 where the lower jaw of the locking plier is closed against the ball of the attaching vehicle. The view would be the same if the ball were mounted on another kind of stationary support where the carrier was being employed as an aid for supporting a nursing animal.
Figure 5:
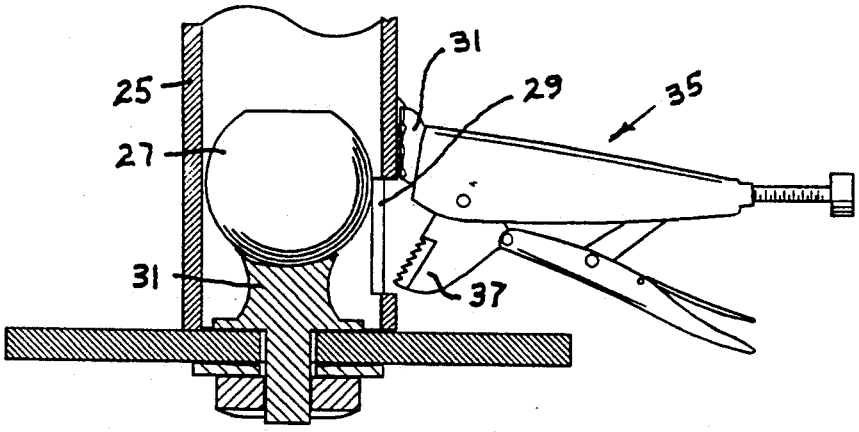
FIG. 5 is a cross sectional view similar to that of FIG. 4 except the lower jaw of the locking plier is shown in its open or unlocked position.

The cantilevered beam 10 is welded or otherwise firmly fixed to the upper end of a hitching tube 25, the inside diameter of which is sufficient to easily fit over the largest diameter hitch ball 27 which would normally be encountered, as seen best in FIGS. 4 and 5. Since most hitch balls of the type mounted on farm vehicles are either 1⅞ inches or 2 inches in diameter, it is appropriate that the hitch of the carrier of the present invention be adaptable to either size hitch. While the hitch does not require exact fit for the short distances to be traveled over rural terrain, it does at the same time require an attachment which will not come lose so as to dump the calf on the ground with the attendant possibility of injury.

The hitching tube 25 is provided with an aperture 29 in its side wall having a vertical length of approximately the same as the distance covered by the lower two-thirds of the ball 27 and its mounting pedestal 31. Welded to the outside wall of the tube 25 just above the aperture 29 is the base 31 of the cut off upper jaw of a locking plier type of tool 35. The lower jaw 37 of the locking plier is then disposed centrally of the window formed by the aperture 29 and positioned so that when the handles of the locking plier 35 are closed the lower jaw comes into contact with the lower outside surface of the ball 27, forcing the ball up into the tube 25 and against the inside of the tubular wall opposite the window aperture 29, as shown in FIG. 4. The plier jaws are then locked, in a manner well known for such a tool, securing the tube 25 and the ball 27 together.

To disconnect the carrier from the ball hitch, the locking plier 35 is unlocked, the jaws opened and the tube lifted easily off the ball.

For nursing support, as mentioned above, the ball 27 may be attached to a plate which is cantilevered from any form of vertical support positioned where the mother cow can be proximately placed. The carrier is attached to the ball is a manner similar to that described above for attachment to the ball hitch of vehicle. A new born or ill calf is lifted up and placed in the cradles 12 and 14 and then has the necessary support to nurse from its mother.

I claim:

1. An animal support comprising;

a cantilevered beam having inner and outer ends, a pair of spaced apart generally "U" shaped body cradle members rigidly attached to the said beam, a mounting post angularly attached to the inner end of the beam and wherein said mounting post comprises a hollow tubular member having an aperture in a side wall thereof, locking plier means having a shortened upper jaw and a lower jaw wherein said shortened upper jaw is attached to the side wall of the tubular member adjacent the said aperture and the lower jaw thereof is disposed within the said aperture.

2. The animal support of claim 1 wherein the body cradle members each comprise, a generally "U" shaped springably flexible strap having a base and a pair of spaced apart upstanding side members and attached to the beam at the mid point of the said base.

3. The combination of claim 2 and further comprising;

an elastic body support member attached to the free ends of the upstanding side members of the generally "U" shaped strap and suspended across the base thereof.

4. The combination of claim 3 and further comprising, rear animal supporting means comprising a rigid bar perpendicularly attached to the beam intermediate the inner end of the beam and the body cradle member which is most proximate to the inner end of the beam.

5. The combination of claim 3 and further comprising animal belly protecting means carried by the beam intermediate the said body cradle members.

6. The combination of claim 5 wherein the said belly protecting means comprises a flexible tubular member.

* * * * *